US005253811A

United States Patent [19]

Sieth

[11] Patent Number: 5,253,811

[45] Date of Patent: Oct. 19, 1993

[54] SHEET FLOW SPOUT

[75] Inventor: Kenneth J. Sieth, Cedarburg, Wis.

[73] Assignee: Kohler Co., Kohler, Wis.

[21] Appl. No.: 789,571

[22] Filed: Nov. 8, 1991

[51] Int. Cl.[5] ..... B05B 1/26

[52] U.S. Cl. ..... 239/523; 239/518

[58] Field of Search ..... 239/518, 521, 523, 524, 239/193

[56] References Cited

U.S. PATENT DOCUMENTS

| | | | |
|---|---|---|---|
| 367,762 | 8/1887 | Murphy | 239/523 |
| 1,085,120 | 1/1914 | Gibbs | 239/521 |
| 1,156,327 | 10/1915 | Stiers | 239/521 |
| 2,186,551 | 1/1940 | Lyon | 239/523 |
| 2,225,836 | 12/1940 | Lund | 239/193 |
| 2,714,531 | 8/1955 | Kromer | 239/521 |
| 2,956,751 | 10/1960 | Burgue et al. | 239/521 |
| 3,069,100 | 12/1962 | Schuler | 239/524 |
| 3,081,041 | 3/1963 | Showalter, Jr. | 239/532 |
| 3,109,593 | 11/1963 | Newland, Sr. | 239/524 |
| 3,144,211 | 8/1964 | Goldman | 239/532 |
| 3,591,091 | 7/1971 | Galloway | 239/523 |
| 4,334,328 | 6/1982 | Delepine | 4/192 |
| 4,513,458 | 4/1985 | Delepine | 4/192 |
| 4,754,622 | 7/1988 | Fanson | 239/523 |
| 4,823,409 | 4/1989 | Gaffney et al. | 4/192 |
| 4,912,782 | 4/1990 | Robbins | 4/192 |
| 4,991,214 | 2/1991 | Bergmann et al. | 4/192 |

FOREIGN PATENT DOCUMENTS

| | | | |
|---|---|---|---|
| 395657 | 7/1922 | Fed. Rep. of Germany | 239/521 |

*Primary Examiner*—Andres Kashnikow
*Assistant Examiner*—Christopher G. Trainor
*Attorney, Agent, or Firm*—Quarles & Brady

[57] ABSTRACT

A spout provides an extended sheet of flowing water for a shower nozzle or the like, by employing a single nozzle spaced from a spherically curved shield to create a sheet. The nozzle may have a noncircular cross-section to increase the lateral water flow out of the nozzle to provide a more uniform sheet after the focusing effect of the shield. The lower edge of the shield is sharpened to prevent the attachment of the sheet to the edge such as might cause an undesired spray of water droplets.

5 Claims, 2 Drawing Sheets

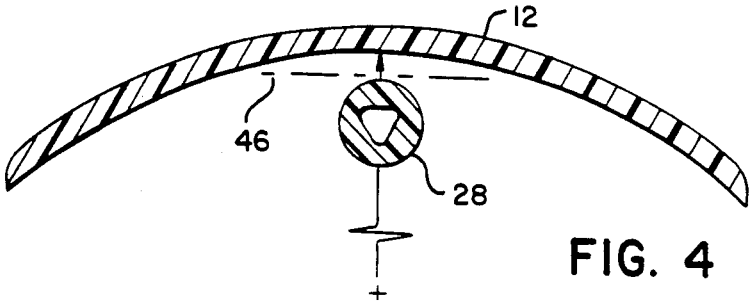
FIG. 4
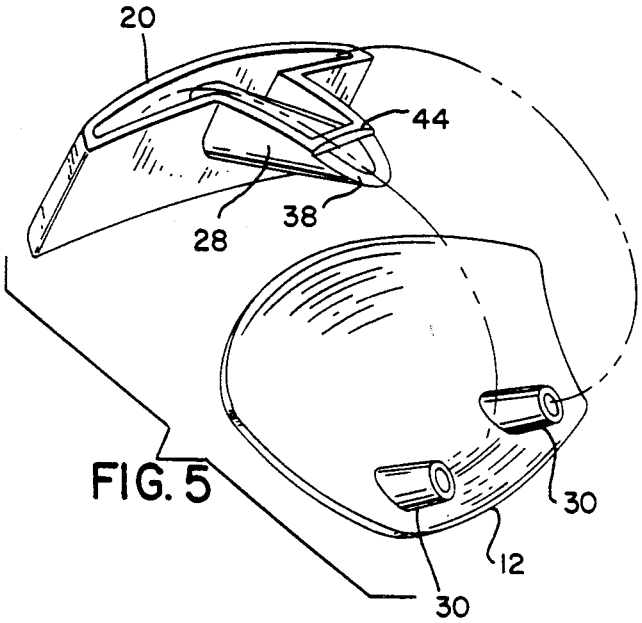
FIG. 5
FIG. 7
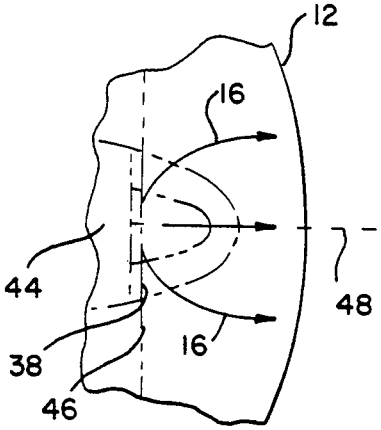
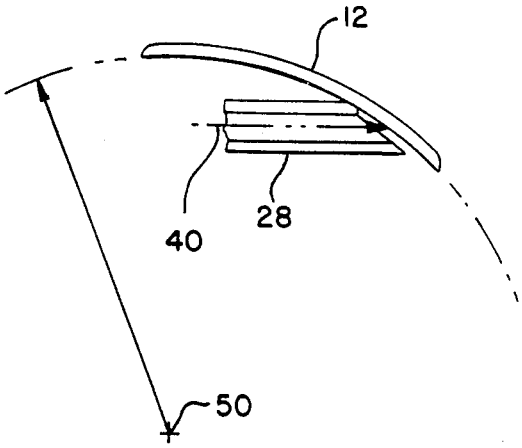
FIG. 6
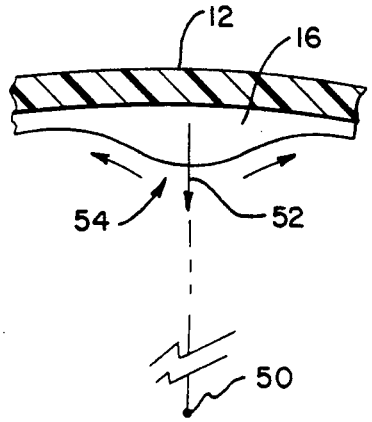
FIG. 8

SHEET FLOW SPOUT

FIELD OF THE INVENTION

The invention relates to spouts that provide a stream of water in the form of a sheet. This design is particularly suited to a shower nozzle or the like.

BACKGROUND OF THE ART

The pleasing esthetic qualities of water flowing in a sheet are well recognized and certain types of spouts for producing these sheets are known. In one type of "sheet flow spout" such as that of U.S. Pat. No. 4,334,328, a narrow slot is formed having a cross-section matching that of the desired sheet of water. A flow chamber between the water supply and the narrow slot smooths the flow of the water so that when it exits the narrow slot, it continues as a sheet for a distance. Producing a wide sheet of water with such a design, using practical rates of water flow, requires that the slot be narrow. Manufacturing a narrow slot is difficult and such a narrow slot may be difficult to clean or susceptible to clogging.

In a second type of sheet flow spout, the narrow slot is replaced by a single deflector which is impinged by a stream of water from a nozzle. The water spreads upon impact with the deflector to form the sheet. This spreading of the water as it strikes the deflector also limits the free length of the sheet before it breaks up into droplets. This is because the thinning of the expanding sheet soon exceeds the limits of surface tension of the water holding the sheet together.

This problem of the diverging sheet thinning too quickly may, to some extent, be overcome by the use of multiple jets, each of which "shepherds" a neighboring jet to prevent the excessive spreading of the water after it leaves the deflector. See e.g. U.S. Pat. No. 4,912,782.

Unfortunately, the use of multiple jets may produce a sheet of uneven thickness and, in any event, may be costly.

SUMMARY OF THE INVENTION

The present invention provides a spout for forming a sheet of water that remains continuous over an extended length as it falls without the use of a narrow slot or multiple jets. A single deflector curved in two dimensions (e.g. spherical) provides both a sheet forming and sheet smoothing typically performed by a narrow slot. The dual curvature of the shield also serves to focus the sheet along an axis to prolong the free length of the sheet without the need for multiple jets.

Specifically, a nozzle accepting a flow of water conducts it along an axis and discharges the water through an orifice toward a shield. The shield has a face portion spaced from the orifice to create a slot between the face portion and rim for forming the water into a primary sheet flowing outward along two orthogonal directions. A guide portion of the shield surrounding the face portion curves inwardly along the two orthogonal directions to deflect the sheet inward before the sheet passes over the shield's outer edge into the air.

The nozzle may be noncircular in cross-section to provide substantially greater water flow off of the nozzle axis. The path between the rim and the face portion opposite the predominate water flow along the nozzle axis may be blocked by a wall.

It is one object of the invention, then, to provide the benefits of a "slot type" sheet flow spout and of "multiple jet" type sheet flow spout but with a single nozzle and shield arrangement. The shield has an outer edge with a face which may be formed to have a tapered sharp edge.

It is another object of the invention to provide a sheet flow spout of the type where the sharp edge reduces the attachment of the water to the deflecting surface.

It is yet another object of the invention to provide a sheet of water with reduced divergence.

Other objects and advantages besides those discussed above will be apparent to those skilled in the art from the description of the preferred embodiment of the invention which follows. Thus, in the description, reference is made to the accompanying drawings, which form a part hereof, and which illustrate one example of the invention. Such example, however, is not exhaustive of the various alternative forms of the invention. Therefore, reference should be made to the claims which follow the description for determining the full scope of the invention.

BRIEF DESCRIPTION OF THE DRAWINGS

FIG. 4 is a cross-sectional view, along the line 4—4 of FIG. 2;

FIG. 5 is a perspective, exploded view of the two main pieces of the sheet flow spout of FIG. 1;

FIG. 6 is a schematic view similar to FIG. 2 showing the radius and center of a theoretical sphere of which the shield is a part;

FIG. 7 is a detail of the shield and nozzle in cross-section, along line 7—7 in FIG. 2, showing the focusing of the streams of water caused by the gradients of curvature of the shield; and FIG. 8 is a detail of FIG. 4 showing the forces acting on unequal thicknesses of the sheet passing along the shield.

DESCRIPTION OF THE PREFERRED EMBODIMENT

Figure 1:
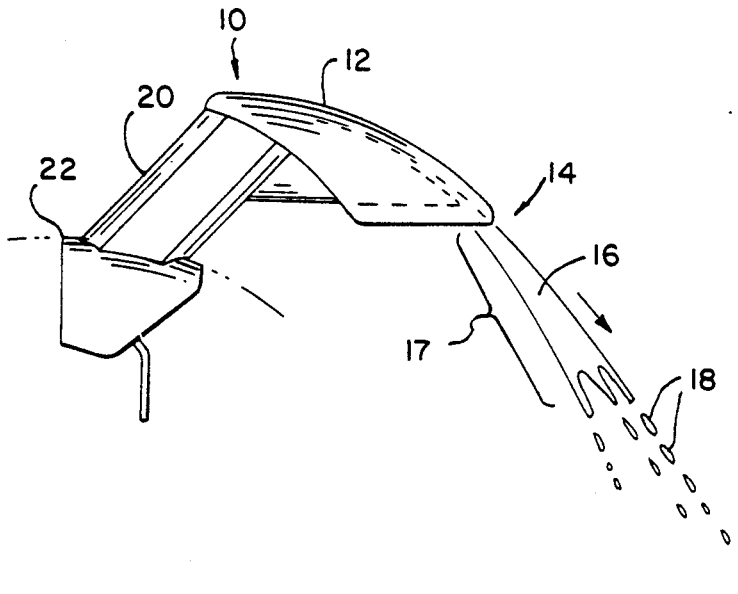
FIG. 1 is a side elevational view of the sheet flow spout of the present invention, showing a sheet of water extending therefrom.

Referring to FIG. 1, the sheet flow spout 10 of the present invention comprises generally a curved shield 12 having an inner surface conforming to a part of a sphere. The shield 12 has a lower edge 14 from which issues a sheet of water 16 extending in air for a free length 17 prior to breaking into droplets 18. The upper edge of the shield 12 attaches to a nozzle assembly 20 which preferably extends upward from a collar 22 attached to a shower assembly (not shown) at head height within a shower stall.

Figure 3:
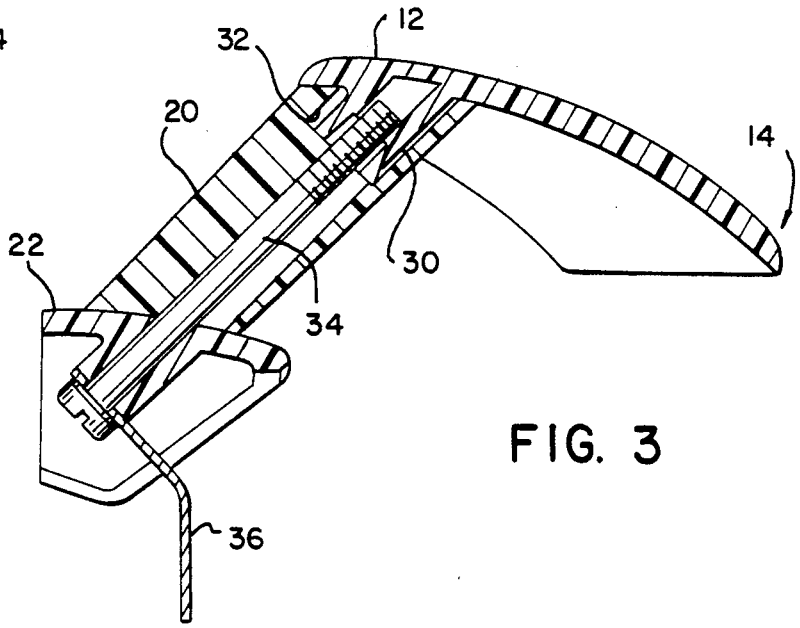
FIG. 3 is a cross-sectional view similar to that of FIG. 2 with the cross-sectional plane displaced from the midline, but parallel to that of FIG. 2.

Referring to FIG. 3, the shield 12 is attached to the nozzle assembly 20 by means of threaded bosses 30 extending from and attached to the lower surface of the shield 12. When the shield is attached to the nozzle assembly 20, the threaded bosses 30 fit into a cavity 32 within the upper end of nozzle assembly 20.

Bolts 34 pass upward through the collar 22 and through bores in the nozzle assembly 20 to be received by the threaded bosses 30 and to be tightened so as to pull the shield 12 firmly against the nozzle assembly 20, the latter sandwiched between the collar 22 and the threaded bosses 30 of the shield 12. The head of the bolts 34 also captures a flange 36 against the lower side of the collar 22, such flange 36 aiding in mounting the sheet flow spout 10 to the supporting shower assembly.

Figure 2:
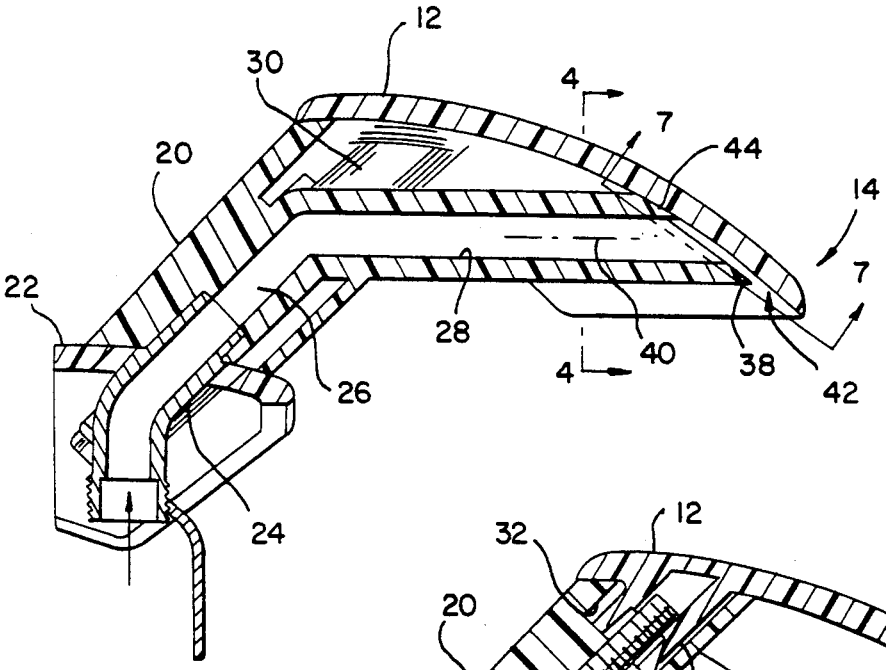
FIG. 2 is a view similar to that of FIG. 1 but in cross-section, the cross section being taken through the midline of the sheet flow spout of FIG. 1 along the plane of the paper.

As shown in FIG. 2, the nozzle assembly 20 incorporates a central inlet coupling 24 for receiving water through the collar 22 from water supply lines (not shown) and for passing that water to a channel 26 within the nozzle assembly 20, and then ultimately to a generally horizontally disposed nozzle 28. Nozzle 28 terminates at an orifice 38 cut at an oblique angle to the generally horizontal axis 40 of the nozzle 28. The angle of the orifice 38 is such as to conform generally to a lower, inner surface of the shield 12 and to be spaced somewhat from that surface to create a slot 42 between the orifice 38 and the lower surface of the shield 12.

As a result of the geometry of the shield 12 and the interaction between the shield and the nozzle 40, as will be described, the slot 42 may be substantially wider than the thickness of the sheet 16 ultimately produced by the spout 10. This thickness of the slot 42 reduces the chance of the slot 42 clogging, as compared to designs employing a much narrower sheet-forming slot.

Referring to FIG. 5, a wall ridge 44 attached to the upper rim 38 and abutting the lower surface of shield 12 prevents the flow of water from the nozzle 28 upward along shield 12 toward the rear of the nozzle assembly 20 thus providing the limits to the angular extent of the slot 42 being approximately 180° around the nozzle axis 40.

Referring now to FIG. 7, water exiting the nozzle 28 from the slot 42 may proceed between orthogonal axes 46 and 48, the latter generally being along to axis 40 of the nozzle 28. Water may exit in a forward direction along axis 48 but not in the backward direction as a result of the wall ridge 44. Water may also exit the nozzle 28 along axis 46 in the left or right direction.

Referring now to FIGS. 4 and 6, the shield 12 curves both along the axis 46 and the axis 48, and preferably is a section of a sphere centered about a center point 50 below and behind the nozzle assembly 12. Each direction of curvature of shield 12 accomplishes a different purpose.

Referring to FIG. 7, the lateral curvature along axis 46 serves to bend the water escaping through slot 42 in the left and right directions along that axis 46 so as to be redirected in substantial alignment with axis 48 in the forward direction but translated from the axis 48 on either side of axis 48. This provides a sheet of water 16 substantially wider than the cross-section of nozzle 28. Thus, surprisingly, a single nozzle 28 may be used to create a substantially wider sheet of water 16 by directing water along the transverse axis 46, such water ultimately being redirected along axis 48 so as to reduce its dispersion and thus its free length prior to forming droplets 18.

Referring to FIG. 8, the forward curvature of the shield 12 along axis 48 serves to accelerate the sheet 16 inward towards the center of the radius of the shield 12 as indicated by arrow 52. The reacting force of this acceleration presses the sheet 16 against the lower surface of the shield 12 and in this process, local thickness variations in the sheet 12 are smoothed by a resulting flow of the water of sheet 16 laterally generally parallel to axis 46. Thus, the centrifugal acceleration of the sheet 16 by the shield 12 promotes a uniformity in the thickness of the sheet 16 prior to it leaving the shield 12 into free air. The more uniform thickness or cross-section of sheet 16 provides the maximum length of unbroken sheet 16 prior to the sheet breaking up into droplets 18 because areas of thinness are eliminated, such areas which would promote the breaking up of the sheet 16.

Referring again to FIG. 4, the cross-section of the orifice is not circular but rather follows a generally triangular outline to provide a greater amount of water flow through the slot 42 in directions not aligned with the primary axis 48 to prevent the focusing effect of shield 12 from unduly increasing the thickness of the sheet 16 along the axis 48.

Referring to FIGS. 1, 2, and 3, the shield 12 at its lower edge 14, is sharpened to provide an acute angle between the lower surface of the shield 12 and the surface of face 56 of the lower edge 14. This acute angle breaks the attachment of the water stream 16 to the lower surface of the shield 12 thus reducing a spray of fine droplets from the edge 56 of the shield 16.

The above description has been that of a preferred embodiment of the present invention and it will occur to those who practice in the art that modifications may be made without departing from the spirit and scope of the invention. In order to apprise the public of the various embodiments that may fall within the scope of the invention, the following claims are made.

We claim:

1. A spout, comprising:

a nozzle for accepting a flow of water from a water supply and conducting it along a nozzle axis to a nozzle discharge orifice; and a shield having a curved surface overlying the orifice that is fixed relative to the orifice, the surface having:

a face portion spaced from and opposing the orifice to create a slot between the shield and orifice for forming the water into a sheet; and a guide portion extending about the face portion in two orthogonal directions and having an outer edge lower than the face portion, the guide portion and the face portion having a curvature inward toward the orifice in the two orthogonal directions for deflecting the sheet inward before the sheet passes the outer edge to promote the formation of a continuous sheet of water suitable in which to bathe.

2. The spout as recited in claim 1, wherein the outer edge of the guide portion is tapered to a sharp edge.

3. The spout as recited in claim 1, wherein the guide portion is spherical.

4. The spout as recited in claim 1, wherein the orifice is generally triangular in cross-section to promote greater water flow along directions across the nozzle axis.

5. A spout, comprising:

a nozzle for accepting a flow of water from a water supply and conducting it along a nozzle axis to a nozzle discharge orifice; and a shield having a curved surface overlying the orifice that is fixed relative to the orifice, the surface having:

a face portion spaced from and opposing the orifice to create a slot between the shield and orifice for forming the water into a sheet; and a guide portion extending about the face portion in two orthogonal direction and having an outer edge, the guide portion having a curvature inward toward the orifice in the two orthogonal directions for deflecting the sheet inward before the sheet passes the outer edge wherein the guide portion is spherical.

* * * * *